United States Patent [19]

Hellman, III

[11] Patent Number: 4,681,378

[45] Date of Patent: Jul. 21, 1987

[54] MODULAR CABLE MANAGEMENT SYSTEM FOR RELATED ELECTRONICS EQUIPMENT

[75] Inventor: Nat Hellman, III, Beverly Hills, Calif.

[73] Assignee: Microcomputer Accessories, Inc., Los Angeles, Calif.

[21] Appl. No.: 866,399

[22] PCT Filed: Feb. 4, 1985

[86] PCT No.: PCT/US85/00180

§ 371 Date: May 20, 1986

§ 102(e) Date: May 20, 1986

[87] PCT Pub. No.: WO86/04494

PCT Pub. Date: Aug. 14, 1986

[51] Int. Cl.[4] ..... A47B 87/02

[52] U.S. Cl. ..... 312/108; 312/107; 312/208; 312/223; 211/188; 211/194

[58] Field of Search ..... 312/107, 108, 194, 195, 312/223, 208, 111; 211/188, 194

[56] References Cited

U.S. PATENT DOCUMENTS

| | | | |
|---|---|---|---|
| 2,140,376 | 12/1938 | Anderson | 361/428 |
| 3,563,882 | 2/1971 | Kimura et al. | 361/428 X |
| 3,763,401 | 10/1973 | Ransom | 317/122 |
| 3,786,765 | 1/1974 | Burr | 312/196 X |
| 3,909,505 | 9/1975 | Taylor | 174/72 |
| 4,163,867 | 8/1979 | Breidenbach | 312/223 X |
| 4,166,195 | 8/1979 | Schwab | 174/95 |
| 4,202,586 | 5/1980 | Oplinger | 211/188 X |
| 4,345,803 | 8/1982 | Heck | 312/239 X |
| 4,418,967 | 12/1983 | Winkelman, Jr. et al. | 312/111 X |
| 4,422,385 | 12/1983 | Rutsche et al. | 312/194 X |
| 4,568,212 | 2/1986 | Cooke et al. | 312/208 X |

FOREIGN PATENT DOCUMENTS

| | | | |
|---|---|---|---|
| 3142858 | 5/1983 | Fed. Rep. of Germany | 312/223 |

*Primary Examiner*—Joseph Falk

*Attorney, Agent, or Firm*—Albert O. Cota

[57] ABSTRACT

A module (20) comprising a top panel (22) that is attached to a pair of opposed side panels (32). The assembly forms a channel or "U" shaped structure with a rear channel cover (42) snapped into place over a channel (26) defining a horizontal raceway. A pair of cable recess covers (46) enclose a recess (34) in the sides (32) providing a duct that forms a path for wires and cables. Electronic equipment is positioned upon the top panel (22) of the module (20) with ancillary components in the area underneath; thus providing a management system for the equipment, including a passageway for interconnecting the wires and cables. A number of modules (20) may be stacked together on a base (60) having casters (62) in each corner. A paper basket (64) and a keyboard storage board (66) may also be added to allow an entire electronic system, such as a computer complex, to be self-contained within the structure.

12 Claims, 19 Drawing Figures

MODULAR CABLE MANAGEMENT SYSTEM FOR RELATED ELECTRONICS EQUIPMENT

TECHNICAL FIELD

This invention relates to systems for laying electrical and electronic cables in distribution raceways and ducts, and more particularly to systems interconnecting associated electronic equipment, while providing a mounting surface closely positioning the apparatus together.

BACKGROUND ART

Various disciplines require specialized structure to interconnect electrical components together. As an example of this prior art, Kimura et al in U.S. Pat. No. 3,563,882 teaches a method of laying electrical cables utilizing frame supporting beams which are horizontally held near the ceiling of a room to support a number of frames. This creates a horizontal plane over the electrical equipment mounted on the floor. This arrangement allows cables to connect the equipment in almost a straight line one from each other.

Anderson discloses in U.S. Pat. No. 2,140,376 an electrical panelboard with various horizontal and vertical troughs to retain the electrical wiring. A series of apertures allow the wires to interconnect from one structure to the component being wired. Horizontal wiring between panels is carried in a horizontal trough superposed on the main vertical runs, but not interfering in any way with them.

U.S. Pat. No. 4,166,195 of Schwab takes advantage of an extruded aluminum channel having a cover with a ground bus attached inside. A cover plate snaps into place while spring retainer clips hold the wires inside to a given corner. The utility is directed to isolated power and equipotential ground systems, such as found in hospital environments utilizing inhalation anesthetics.

Taylor discloses in U.S. Pat. No. 3,909,505 a modular electrical component mounting assembly with an integral wiring duct. This apparatus allows relays and related components to be mounted on the assembly while providing a duct for electrical conductors attached therebetween. A raised platform with a pattern of mounting holes is formed between adjacent mounting modules and contains a cover plate for containment.

Similarly, U.S. Pat. No. 3,763,401 issued to Ransom teaches a wiring duct for carrying a group of wires and is formed of an electrical insulating substance, such as vinyl plastic. This duct includes terminals of an electrical conductive material extending through the wall at a number of locations along the length.

It will be seen that prior art has approached the problem on an individual basis to provide an answer to a specific issue, none of which show or suggest the applicants disclosure.

DISCLOSURE OF THE INVENTION

The advance of the state of the art and the economy of scale has made the small business and home computer available to the masses. A special problem has arisen due to the fact that a computer system is not necessarily housed in a single enclosure. Many different manufacturers of computers allow interchangability of ancillary equipment to be utilized. This allows flexibility of the system using the right combination of equipment for the job at hand. Although standards are not particularly set up in this industry, the use of interchangeable coaxial cables and interface connections is customary. Since size of each component is not the same and the function many times dictates the configuration, a considerable amount of space is required for a system if it is all positioned together on a flat surface, such as a table or desk. Further, along with the individual space requirements, room must be allowed for the cablery, interconnecting wiring and power input feeds. In most cases the components are not designed to stack one on top of the other ,as the physical envelope configuration between manufacturers are not universally accepted.

As the above problem of space requirements for a computer complex persists, it is the primary object of the invention to take advantage of a modular system that provides a mounting surface for a component on top of an existing area. This is accomplished with an individual "U" shaped module forming a shelf on top and a mounting area underneath, such as on a desk or table. Further, one module may be stacked on top of the other defining a multiple shelf-like structure wherein the entire combination may be housed within a small area. This system is further adaptable to have a base with casters on the bottom to rest on the floor eliminating the requirement for a secondary structure completely. Inasmuch as the module is flexible in its mounting arrangement, any combination may be used to fit the particular computer complex. An example of this is depicted in FIG. 1 with the elements shown in a working relationship.

An important object extends the utility of the module to include electrical raceways and ducts that provide a path to connect the components together. This provision allows wires to be routed directly within an enclosed chamber which has a labyrinth of passageways adaptable to the electronic equipment. As the components are stacked one on top of the other, the conductors are fed through the raceway at the back, where the interconnecting wires usually originate, and are directed up or down a duct at the side to the next horizontal raceway or any combination therebetween.

Another object provides not only a convenient passageway for the wires, but a system having asthetic values. This object allows the components to be enclosed out of view within each shelf and the wiring almost completely out of sight. As the cable raceways are conveniently located, the only exposed wires run directly into the structure at the shortest possible point. Tabs along the top of the raceway may be broken off to gain access at the most desirable location, and even excess cable may be doubled or looped and stored inside away from view. The radiused corners and recessed sides of the modules add an appearance of strength and utility not unlike the components housed within.

Yet another object of the invention includes the use of an auxillary platform installed on the top of the module allowing a cathode ray tube (CRT) monitor to be mounted on top of the assembly.

Another object provides a refold stack guide to be attached to the rear of the assembly that guides the paper, from the printer, into a box or receptacle allowing it to refold into a vertical stack much like the stack of paper being fed originally into the printer. This guide is attached into an indexing hole on the rear of the module and is made in a wireform.

Still another object of the invention addes a degree of utility not heretofore utilized in the art. Some printers used as peripheral equipment in computer systems have a bottom loading feature that allows the paper to feed into the device underneath with the processed paper ejecting from the top or back. The invention includes a slot centrally located in the top panel, allowing the paper to pass through the shelf itself. With the opening in this location, the paper may be conveniently stored underneath in a box or container and simply unfold upward directly into the printer.

Still further, a paper receiving basket is provided on the cable management system modular assembly that is detachably affixed to the rear of the appropriate module. This allows the processed paper to be retained near the printer at the rear.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 2:
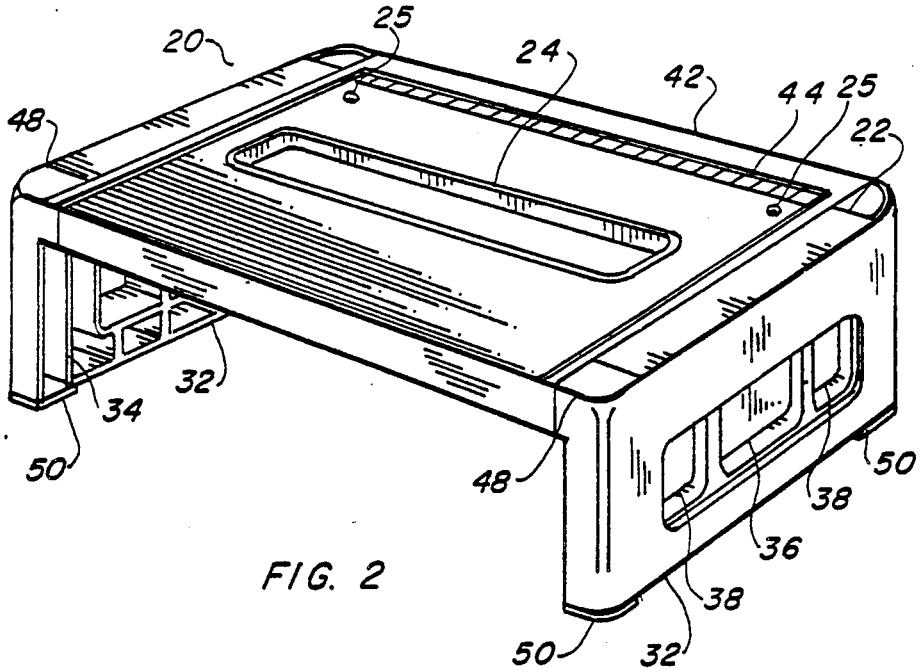
FIG. 2 is an isometric view of the individual module shown from the front.
Figure 3:
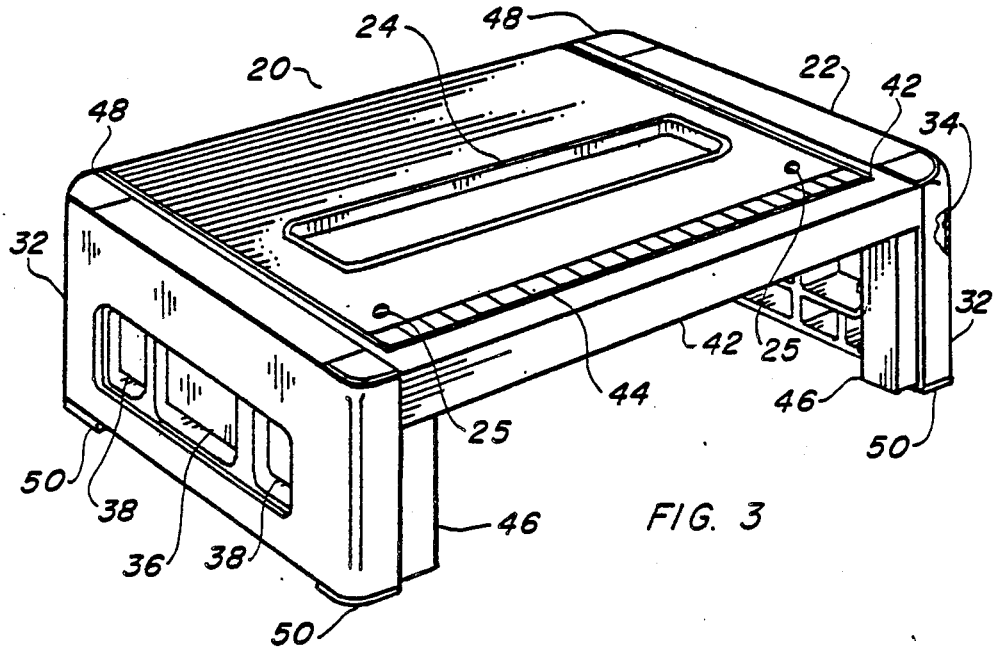
FIG. 3 is an isometric view of the individual module shown from the back.

Referring now in detail to the drawings and describing the preferred embodiment, the invention consists of a system utilizing a plurality of modules as pictorially illustrated in FIGS. 2 and 3. The basic module 20 contains a top panel 22 having a flat surface for mounting equipment with reinforcing members formed into the underside for stiffness and strength. The panel 22 also contains a slot 24 positioned in the approximate center, at least the width of conventional computer paper and of a depth to conveniently pass this paper through while it unfolds underneath. A channel 26 is formed integrally in the rear of the panel 22 with the ends terminatihg prior to each outside edge. The bottom surface of this channel shaped portion 26 contains a series of cavities 28 at spaced relationship. The channel 26 provides a trough, or raceway, to receive and store electric wires and cablery from the computer complex. The channel 26 ends that are shorter allow vertical routing in the void and the cavities 28 provide a direct passageway from the channel 26. A plurality of threaded bosses 30 are molded into the bottom surface of the panel 22 in the proximity of each of the corners and are used for attachment. The upper surface of the top panel 22 further contains a pair of auxillary mounting holes 25 that penetrate through the surface. These holes 25 are positioned near the rear and outside corners and allow attachment of ancillary equipment.

Figure 7:
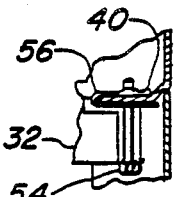
FIG. 7 is a partial sectionalized view of the fastening means and threaded boss of the top panel for connecting the device together.
Figure 8:
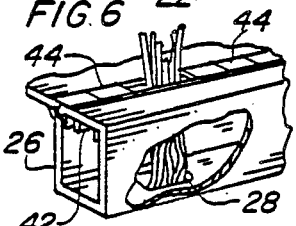
FIG. 8 is a partial isometric view of the rear of the top panel with the rear channel cover in place cut-away to depict the cable duct with one of the tabs removed and a length of wires and cables penetrating through from the cavity underneath.

Attached at each end of the top panel 22 is a side panel 32 that fashions the module 20 into a "U" or channel shape. These side panels 32 are configured alike and are installed oppositely, however, being basically symmetrical they match as a mirror image. The panel 32 contains a cable recess 34 at each extremity, front and back, in the form of a channel or half of a duct. A handle recess 36 is located in the center of the panel, which provides a lifting surface to place ones fingers when moving the module 20. The recess 36 is rectangular in shape having ample finger room with a flat surface all around. Between the front of the panel and this recess 36, and also in the back, is an opening 38 that continues through the structure. This opening 38 is for cable or power cord exit from the side, or for convenience to visualize the components therein. A number of reinforcing ribs are formed into the structure to add strength and structural integrity similar to the top panel 22. A mating flange 40, shown best in FIG. 7, is contiguous with the top panel 22 and forms a surface for attachment therebetween.

A rear channel cover 42 is formed slightly larger than an interlocking set of grooves in the top panel 22, allowing the cover to be bent slightly and snapped into place over the channel 26 formed in the top. This cover 42 then encloses the channel 26 forming a horizontal raceway for wiring and cablery. While the bottom of the raceway is provided with cavities 28 for connecting the top surface of the cover 42 contains a series of tabs 44 that may be broken away to provide further access. These tabs 44 are integral with the cover 42 and are scored in a geometrical array with grooves, allowing them to breakaway without affecting the surrounding structure. An interlocking portion, best illustrated in FIG. 5, on the underside ends corresponds inversely to the corners of the top panel 22 allowing the top to cosmetically envelop the corner hiding the junction from sight.

Figure 5:
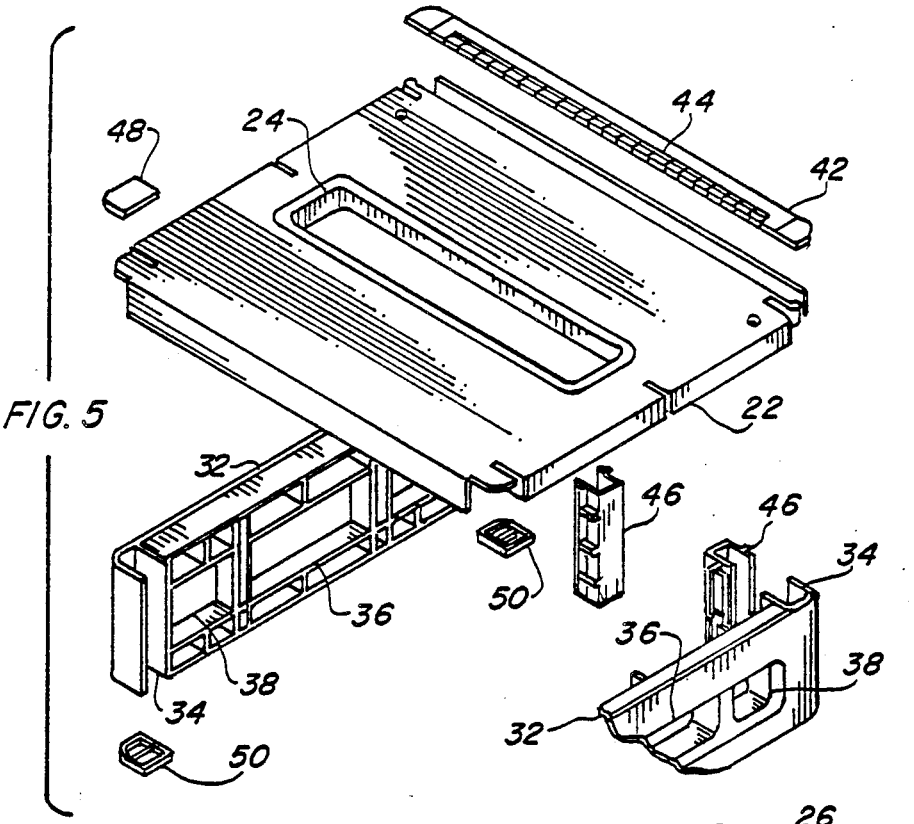
FIG. 5 is an exploded view of the modular assembly viewed from the front with the fastening means omitted for clarity.
Figure 6:
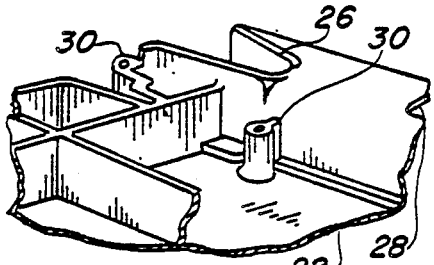
FIG. 6 is a partial isometric view of the top panel turned completely 180 degrees from its normal mounting plane showing the rear corner with its cable containing channel and a portion of one of the cavities therein.
Figure 9:
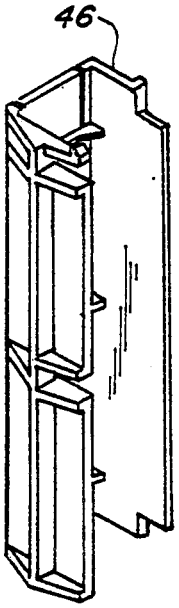
FIG. 9 is an isometric view of the side recess cable cover as seen from the front, completely removed from the module for clarity.
Figure 10:
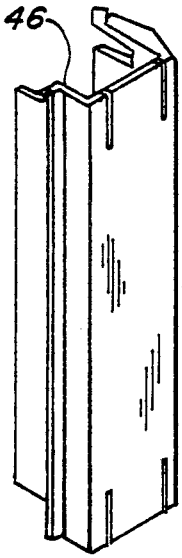
FIG. 10 is an isometric view of the side recess cable cover as seen from the rear, completely removed from the module for clarity.

In order to form a cable duct from the recess 34 in the side panel, a cable recess cover 46 is snapped into place over the top of the channel shaped end. This cover 46, illustrated in FIGS. 9–10, is removed from the assembly, and is also shown in FIG. 5 as an exploded view. The cover 46, as noted, is shaped like a "U" and has both ends open. A resilient hooked finger projects from the top and interfaces with the side 32 at the corner junction. Reinforcing gussets are included on the outside surface, shown in FIG. 9, that add stiffness and provide structural integrity as in other components.

Figure 12:
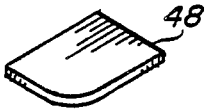
FIG. 12 is an isometric view of one of the top corner caps as seen from the top completely removed from the module for clarity.
Figure 13:
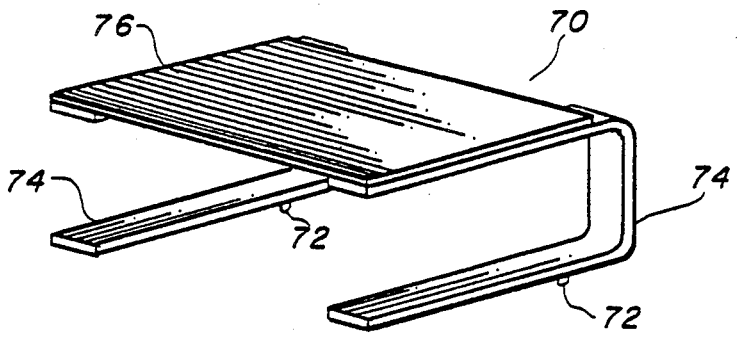
FIG. 13 is a partial isometric view of the mounting platform completely removed from the module for clarity.

The individual module 20 includes a pair of top corner caps 48 that frictionally engage the top panel 22 at the front corners opposite the channel cover 42 completely covering the interface of the corner. The shape of this cap is complementary to the corner structure on the inside and provides a flat continuous surface on the top. This cap 48 is shown removed from the assembly in FIG. 12.

Figure 11:
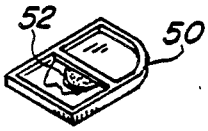
FIG. 11 is an isometric view of one of the bottom corner caps as seen from the top partially cut-away to illustrate the resilient base. This component is completely removed from the module for clarity.

Four removable bottom corner caps 50, depicted in FIG. 11, are provided to complete the structure at the bottom of the side panels 32. Each cap 50 includes a resilient foot 52 adhered to the bottom surface. This foot 52 is of a pliable material and is attached either by a pressure sensitive backing or a portion in dome shape, not shown, forced through a hole in the parent material. This foot 52 provides a non-slip face for the assembly to rest upon and prevents maring of a finished surface, such as a desk.

The side panels 32 and top 22 are connected together with attaching means, such as a threaded fastener 54 in conjunction with a "U" shaped spring clip 56. These elements are shown in FIG. 7 and restrain the panels 22 and 32 at each of the four corners. The fastener 54 may be in the form of a self-tapping, or sheet metal screw and penetrates a boss on the top 22 cutting its own threads as it is screwed into place. The spring clip 56 is retained onto a flange on the side panel 32.

This module 20 is basically constructed of a thermoplastic material that is injection molded. The material may be any moldable type suitable for the application, such as polycarbonate, polypropolene, polyethylene, styrene acetal, ABS (acrylonitrilebutadiene-styrene), acrylic or melamine-formaldehyde, and the like. Texture may be added at appropriate locations on the outside surface for a cosmetic effect.

Figure 1:
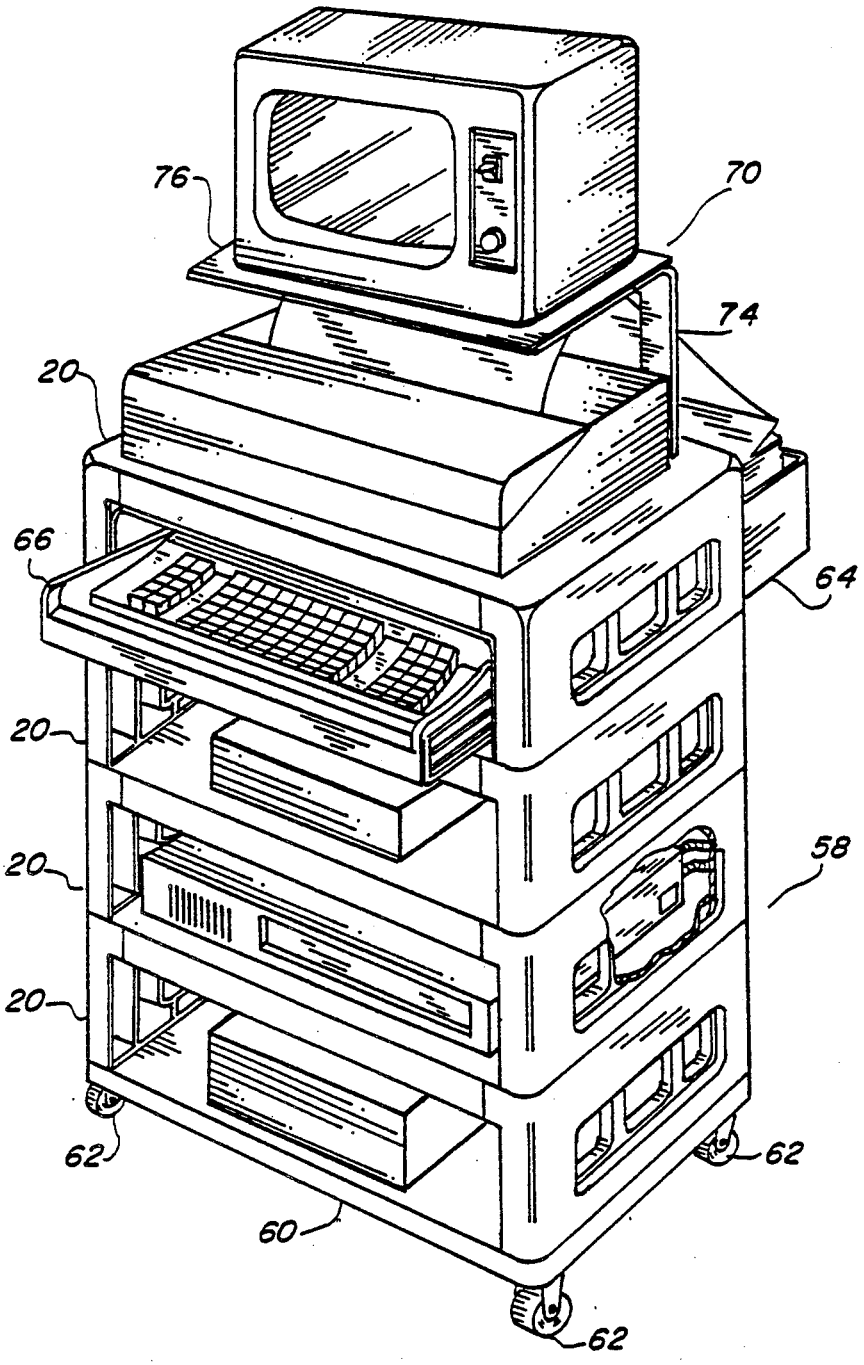
FIG. 1 illustrates the preferred embodiment of the modular assembly with a base in isometric perspective having a computer and ancillary equipment mounted within, thereby showing the interrelationship of components.
Figure 4:
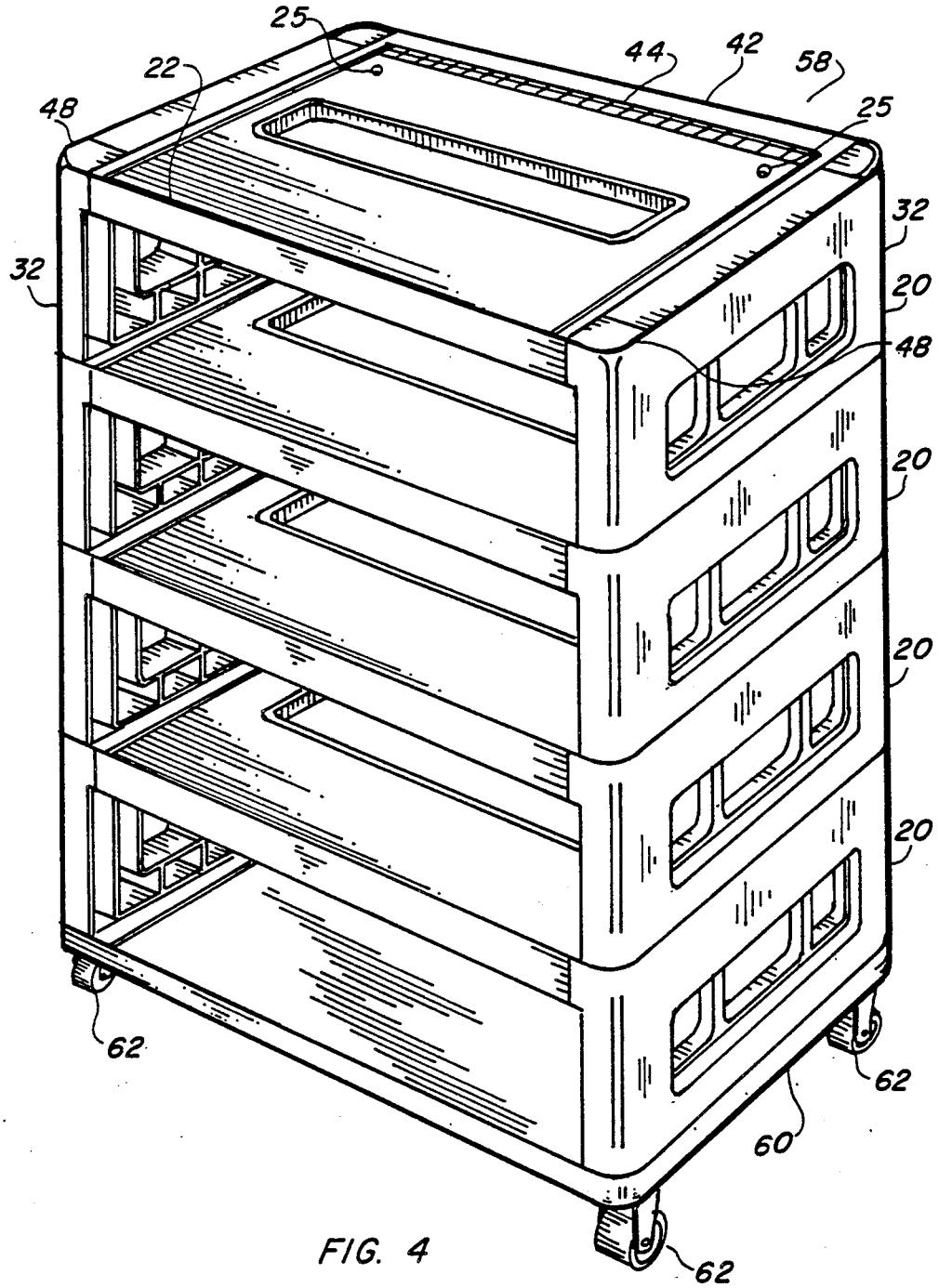
FIG. 4 is an isometric view of the modular assembly with a base viewed from the front.

The module 20 alone may be used for small electronic systems or may be stacked into a modular assembly 58, as shown in FIGS. 1 and 4. The only difference in the module 20 is that the top corner caps 48 are installed only on the uppermost module in the stack, and the bottom corner caps 50 are omitted completely. In this embodiment the recess 34 forming the vertical duct on each rear side along with its cover 46 are in communication with the horizontal raceway on each level. This relationship forms an interconnecting matrix of cable passageways, allowing electrical and electronic cables to connect each component in the computer complex while being hidden from view. With this assembly 58 one of the modules 20 may receive a printer with bottom loading capabilities with the slot 24, providing access for paper stored underneath to be fed therethrough.

A rectangular base 60 may be added to the assembly 58 affixed to the bottom-most module 20 with casters 62 mounted at each of the four corners. This base 60 provides mobility for the assembly 58 for moving from one locations to another. The base 60 is preferably constructed of wood chip board with a laminated top surface and sides.

This arrangement allows the electronic correlated equipment and ancillary items necessary for a computer complex to be positioned in associated relationship. An example of this arrangement is shown in FIG. 1 with a printer on the top, a keyboard on the next shelf down, next paper storage, the system or computer beneath that and another ancillary device on the bottom. It will be noted that the paper is not directly beneath the printer, but is routed outside the second module to the top, where it enters the printer through the slot 24 in the panel 22.

FIG. 1 also depicts another element in the form of a paper receiving basket 64 that is detachably affixed to the upper module 20. This basket 64 has a bottom side and an open top with the size being slightly larger than the computer printer paper that it receives and temporarily stores. This basket 64 may be of any material suitable for the purpose, such as formed wire welded at the junctions and electropolated with a coat of metal, such as zinc or cadmium, or compression molded thermoplastic.

Figure 16:
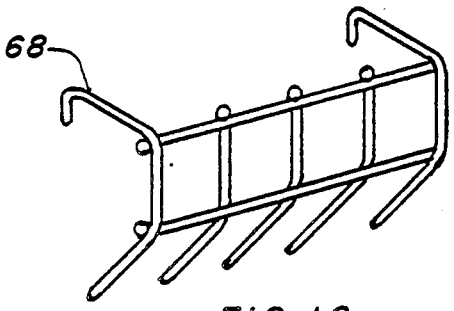
FIG. 16 is a partial isometric view of the refold stack guide completely removed from the module for clarity.
Figure 17:
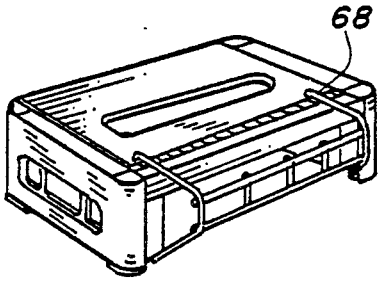
FIG. 17 is a partial isometric view of another embodiment including the refold stack guide in place on the assembly.
Figure 18:
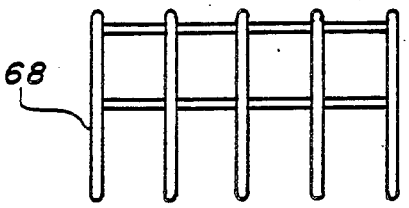
FIG. 18 is a elevation view of the stack guide removed from the assembly.
Figure 19:
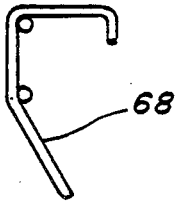
FIG. 19 is a side view of the stack guide moved from the assembly.

An alternate component to the paper receiving basket 64 is a paper folding guide 68 attached to the auxillary mounting holes 74 in the top surface of the module 20. This element guides the paper in such a way as to refold into a vertical stack much like that fed into the printer. The guide 68 is fabricated of a wireform made by forming individual wires into a given shape and placing them one on top of the other and resistance welding the intersections. This device is shown removed from the assembly in FIG. 16, 18 and 19 also as assembed in FIG. 17.

This guide eliminates the need for the paper receiving basket 64, described above, and allows the whole assembly to be placed against a wall thus taking up a minimum of floor space.

Another component that may be added to the assembly for convenience is an electrical power strip, not shown, that includes a series of female connectors on one end and a plug on the other. A flexible stranded wire links the two together and the strip is mounted adjacent to one of the cable raceways or ducts, allowing the electronic equipment to attach individual power input plugs. This allows convenient out of sight transfer of electrical energy from an external source to the modular assembly.

A keyboard storage drawer 66 is attached to the inside surface of the side panels 32. This drawer has a base with sides and a flange upwardly formed in the front and rear. A pair of interlocking slides are rigidly mounted to both the drawer 66 and side panel 32, allowing the drawer to be slid forward providing a tray with complete access to a keyboard that may be mounted thereon.

Figure 14:
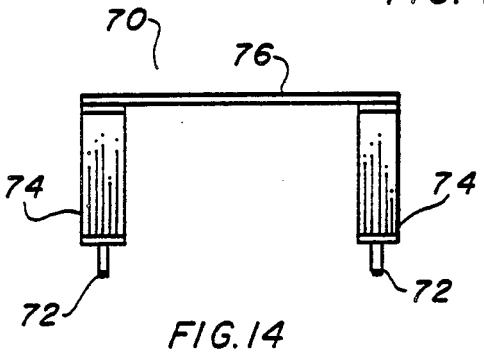
FIG. 14 is a front view of the platform removed from the assembly.
Figure 15:
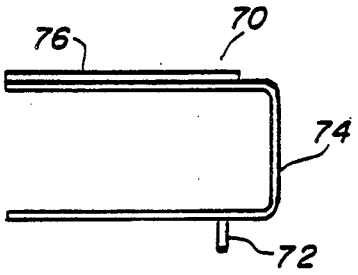
FIG. 15 is a side view of the platform removed from the assembly.

Another alternate component may be added to the assembly in the form of a platform 70 best illustrated in FIGS. 1 and 14. The platform 70 consists of a pair of legs 74 in "C" shape with the top surface of the legs attached to a mounting plate 76 and the bottom outside surface planar with the module top panel flat upper surface.

This platform 70 provides a convenient location to position a CRT monitor as shown in FIG. 1. The platform 70 is located on top of the assembly and held into place with a pair of locating pins 72 distending downwardly from the horizontal legs of the platform. These pins 72 indexingly engage a mating pair of auxillary mounting holes 25 in the top surface of the module 20 and the weight of the CRT monitor is sufficient to hold the platform in place.

While the invention has been described in complete detail and pictorially shown in the accompanying drawings, it is not to be limited to such details, since many changes and modifications may be made to the invention without departing from the spirit and the scope thereof. Hence, it is described to cover any and all modifications and forms which may come within the language and scope of the claims.

I claim:

1. An electronic equipment cable management system module comprising:

(a) a top panel having a flat upper surface with a slot centrally located therein, auxillary mounting holes extending therethrough, reinforcing members on the underside and a channel formed in the rear;

(b) a pair of opposed side panels each having a top, bottom, and two ends with both ends having an integral vertical cable recess with cap engaging means at each end, also the side panels having attachment means at the upper ends thereof for connecting to opposite sides of said top panel, forming a channel shaped modular structure that comprises a raised surface upon which electronic equipment may be mounted;

(c) a rear channel cover having a plurality of breakaway tabs integral therewith resiliently fastened to said channel formed in the rear defining a rear channel cover enclosed raceaway for receiving cablery from said electronic equipment, allowing egress of cables at selected locations by removal of selected tabs;

(d) a plurality of side cable recess covers in "U" shape having both ends open contiguously joined with said side panel recess forming an open ended passageway with the side panel recesses at the rear end in communication with the rear channel cover enclosed raceway;

(e) at least two top corner caps frictionally connected to said top panel at the end opposite the rear end, with the corner caps having means for superimposing the interface of said top and side panels cosmetically enveloping the juncture;

(f) a plurality of removable bottom corner caps, each having a resilient foot diposed thereunto frictionally connecting the bottom corner caps to the bottom corners of said side panels, said removable bottom corner caps providing a resilient base allowing said module to rest upon a flat surface without slipping; and, (g) said channel shaped modular structure allowing electronic equipment to be disposed upon the panel, such as a computer printer with space between the sides allowing storage for paper, said panel slot providing access for paper to be fed into printers having bottom loading capabilities.

2. The invention as recited in claim 1 wherein said top panel further comprises:

a plurality of threaded bosses positioned in the proximity of the corners receiving said attaching means connecting therewith, said channel formed in the rear having the ends terminate prior to the edge allowing electrical cables to be directed into said side panel, also said channel having a plurality of cavities in the bottom portion permitting electrical cables to exit therethrough at convenient locations from electronic equipment placed thereupon.

3. The invention as recited in claim 1 wherein said side panel further comprises:

(a) a handle recess integral with the center for lifting with one hand on each panel providing finger room and a flat surface thereupon, said panel also having a plurality of openings therethrough for cable exit and convenience;

(b) a plurality of mating flanges contiguous with said top panel allowing said fastening means to attach the panels to the top; and, (c) an open "U" shaped portion formed into each vertical end creating a cable recess in line with said top panel channel permitting electrical cables to be positioned therein.

4. The invention as recited in claim 1 wherein said rear channel cover further comprises:

an interlocking raised portion integral with the underside ends corresponding inversely to said top panel corners and interlocking therewith, allowing the top to cosmetically envelop the corner.

5. The invention as recited in claim 1 wherein said side cable recess covers further comprise:

a plurality of reinforcing gussets formed on the outside surface for adding stiffness and to provide structural integrity to the element, also a resilient hooked finger projecting from the top to urgingly interface with said side panel for attachment thereunto.

6. The invention as described in claim 1 wherein said attaching means further comprise:

a threaded fastener with a spring clip retainer restraining the structure at each corner.

7. An electronic equipment cable management system modular assembly with a base comprising:

(a) a plurality of modules nestingly detained on top of each other in a vertical array, each modual having:

a top panel with a flat surface having a slot centrally located therein, reinforcing members on the underside and a channel formed in the rear, a pair of opposed side panels each having a top, bottom, and two ends with both ends having an integral vertical cable recess with cap engaging means at each end, also the side panels having attachment means at the upper ends thereof for connecting said side panels to opposite sides of said top panel, forming a channel shaped modular structure creating a raised surface in shelf manner upon which electronic related equipment may be positioned, a rear channel cover having a plurality of breakaway tabs integral therewith reresiliently fastened to said channel formed in the rear defining rear channel cover enclosed raceaway for receiving cablery from said electronic equipment allowing egress of cables by removal of selected tabs, a plurality of side cable recess covers in "U" shape having both ends open contiguously joined with said side panel recess forming an open ended passageway with the side panel recess at the rear end in communication with the rear channel cover enclosed raceway, the side panel recesses being in communication the entire height of said modular assembly, each module in communication with each said rear channel cover enclosed raceway (b) at least two top corner caps frictionally connected to the uppermost top panel at the end opposite the rear end, with the top corner caps having means for superimposing the interface of said top and side panels cosmetically enveloping the juncture; and, (c) a rectangular base rigidly affixed to the bottommost module having a plurality of casters, at least one at each corner, providing mobility for said modular assembly for moving from one location to another, said assembly also providing a plurality of shelves allowing electronic correlated equipment and ancillary items to be positioned in associated relationship within, the modular assembly also permitting one of the modules to receive a printer with bottom loading capabilities said top panel slot providing access for paper to be fed therethrough.

8. The invention as recited in claim 7 further comprising:

a paper receiving basket detachably affixed to one of the modules having a printer as a workpiece located thereon, said basket having a bottom, sides and open top slightly larger in size than printer paper for receiving and temporarily storing the paper.

9. The invention as recited in claim 7 further comprising:

an electrical power strip having a plurality of female connectors on one end, a plug on the other with a flexible stranded wire linked therebetween mounted adjacent to one of the cable raceways for transmitting electrical energy from an external source to said modular assembly powering the electronic equipment positioned thereupon.

10. The invention as recited in claim 7 further comprising:

a keyboard storage drawer having a base and a pair of interlocked slides rigidly connected to one of the modules on the inside surface of the opposed side panels providing a tray for receiving a keyboard allowing storage inside the module and repositioning to the outside when in use by an operator.

11. The invention as recited in claim 7 further comprising: a wireform paper folding guide attached to said module through said auxillary mounting holes shaped in such a manner as to guide printer paper by refolding into a vertical stack onto said module top panel.

12. The invention as recited in claim 7 further comprising: a mounting platform having a pair of legs in "C" shape, the top surface attached to a mounting plate and the bottom surface containing a pair of locating pins, said platform disposed contiguously upon said modular top panel, the pins intimately engaging said auxillary mounting holes providing a flat extended surface to which an electronic component may be securely mounted.

* * * * *